United States Patent [19]

Reams et al.

[11] 4,085,588

[45] Apr. 25, 1978

[54] CONCENTRIC CROSSFLOW RECUPERATOR FOR STIRLING ENGINE

[75] Inventors: Lowell A. Reams, Plymouth; Thomas F. Dunlap, Riverview, both of Mich.

[73] Assignee: Ford Motor Company, Dearborn, Mich.

[21] Appl. No.: 673,789

[22] Filed: Apr. 5, 1976

[51] Int. Cl.[2] ..... F02G 1/04

[52] U.S. Cl. ..... 60/517; 165/52; 165/166

[58] Field of Search ..... 165/52, 66, 125, 165, 165/166; 60/517; 123/122 D, 39.51

[56] References Cited

U.S. PATENT DOCUMENTS

| | | | |
|---|---|---|---|
| 3,717,993 | 2/1973 | Potter | 165/52 X |
| 3,818,984 | 6/1974 | Nakamura | 165/166 |
| 3,889,744 | 6/1975 | Hill et al. | 165/165 X |
| 3,898,841 | 8/1975 | Kaneler et al. | 60/525 |
| 3,942,324 | 3/1976 | Johansson et al. | 60/517 |

FOREIGN PATENT DOCUMENTS

| | | | |
|---|---|---|---|
| 2,328,792 | 7/1972 | Germany | 60/517 |

*Primary Examiner*—Allen M. Ostrager

*Attorney, Agent, or Firm*—Joseph W. Malleck; Olin B. Johnson

[57] ABSTRACT

A Stirling engine adapted to automotive propulsion is disclosed using an improved preheater construction in the external heating circuit. The preheater construction is comprised of a concentric toroid placed about the heater tube array, the inner cylindrical wall of the ring serving as a wall to define the heating chamber for the closed working fluid circuit. The concentric ring is totally ceramic with alternating orientation of finned ceramic walls fused together to define a cross-flow matrix. Static seal rings of woven ceramic material encased in folded metal foil are retained along the annular edges of at least the upper and lower faces of the concentric toroid to facilitate cross-flow fluid connections.

2 Claims, 3 Drawing Figures

CONCENTRIC CROSSFLOW RECUPERATOR FOR STIRLING ENGINE

BACKGROUND OF THE INVENTION

The Stirling engine was originally conceived as long ago as 1816 by Rev. Stirling. During the middle of the 19th. Century, commerical applications of this hot gas engine were devised to provide rotary power to mills; these were fixed power plants. The Stirling engine was ignored thereafter until the middle of the 20th. Century because of the usefulness and popularity of the internal combustion engine. Not until very recently has the Stirling engine been visualized as a power plant to motorize moving vehicles. Converting a Stirling engine to automotive use presents many formidable problems due to reduced weight, size, energy conservation, cost and reliability limitations that are placed upon it.

One of these problems, energy conservation (engine efficiency), has stimulated the introduction of several modifications to make the Stirling engine suitable for automotive use. The Stirling engine employs a continuously operating external circuit which tends to waste considerable energy via exhaust gases released to atmosphere. For fixed power plants of the Stirling type, heavy steel heat exchangers were previously devised to return a proportion of the exhaust heat energy to the inducted air to facilitate combustion. Upon conversion to automotive use, the heavy steel heat exchangers were replaced by rotary ceramic preheaters which earlier had found utility in gas turbine engine applications. The rotary preheater functioned to expose hot gases through a crescent shaped opening (a one-half circle) to a rotating ceramic wheel, and separately exposed inducted air to the heated wheel at an independent crescent shaped opening.

Although the new art of making unit-directional ceramic heat exchanger cores was most welcome, certain attendant problems were not welcome, such as cost of the crescent shaped seals, the energy loss from the motor drive, the decrease of reliability due to mechanical stress placed upon the fragile ceramic core by dynamic rubbing seal contact, and the lack of the uniform heat flux into the heater tube array due to the non-uniform air flow entering the combustor from the preheater.

SUMMARY OF THE INVENTION

The primary object of this invention is to provide a modified preheater construction for a Stirling engine useful in automotive applications, the improved preheater construction being capable of increasing engine efficiency and decreasing energy losses of the external heat circuit.

Another object of this invention is to provide a Stirling engine having an improved external heating circuit which is effective to increase heat transfer to the closed cycle working fluid circuit, and in particular provide a highly uniform annular heat flux to the heater tube array of the engine.

Yet still another object of this invention is to provide an improved preheater construction for an automotive type Stirling engine which (a) reduces the cost of manufacture, (b) facilitates a low pressure external heating circuit having less pressure drop through the external circuit, (c) provides a more durable preheater construction which eliminates mechanical stresses and noise resulting from dynamic rubbing seals, and (d) reduces or eliminates the need for special insulation on the heater head jacket.

Specific features pursuant to the above objects comprise (a) the construction of completely concentric cross-flow ceramic preheater having a plurality of ceramic plys each with rows of fins extending from said ply outwardly to one side thereof defining elongated cells, said plys are sandwiched together in alternating orientation so as to define a radially varying cross-flow characteristic; the fin height, fin pitch and ply thickness are each controlled to define an optimum porosity for said heat exchange matrix and to reduce the cost of manufacture; (b) subdividing the concentric ring into segments, the joint between segments serving as a thermal stress reliever; (c) the cross-flow ceramic heat exchanger is arranged concentrically about the heater tube array of the Stirling engine to act as a cylindrical wall for the heating chamber.

DETAILED DESCRIPTION

Figure 1:
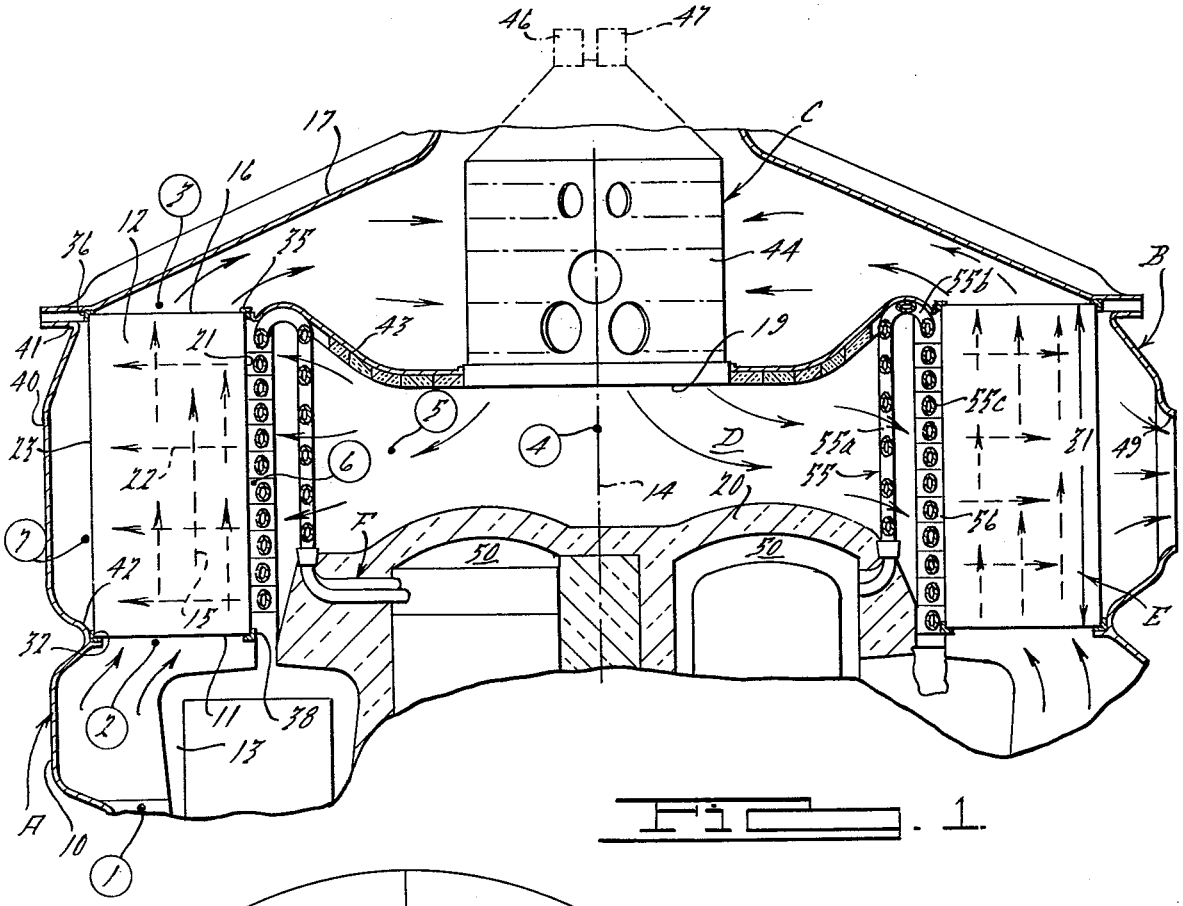
FIG. 1 is a fragmentary sectional view of a heater head assembly for a Stirling engine, said assembly employing an improved preheater construction according to this invention.
Figure 2:
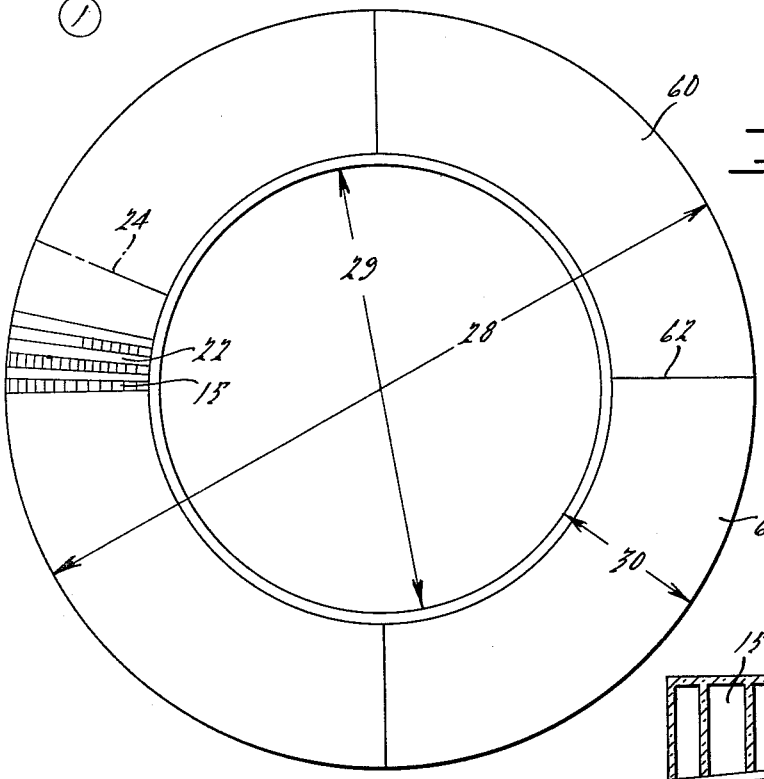
FIG. 2 is a plan view of the preheater ring of this invention.
Figure 3:
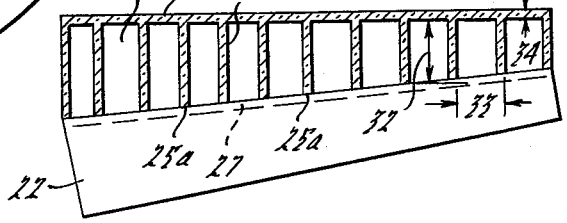
FIG. 3 is an enlarged fragmentary sectional view of a portion of the concentric ring illustrating the definition of cross-flow passages.

A preferred embodiment is illustrated in FIGS. 1-3 comprising in its broad aspects an external heating circuit comprised of an induction means A and exhaust means B, a combustion unit C, a heating chamber D, and a concentrically arranged heat exchanger means E. The external heating circuit is in continuous operation during engine use. Heat generated by the external heating circuit is transferred to a closed working fluid system F which is cycled to promote work on a driven means by transfer of thermal energy.

The induction means A normally receives a supply of air which is positively moved by way of a blower (not shown) in a passage 56, the blower receiving ambient air typically at a 100° F temperature or below. By virtue of the air compression imposed by the blower, the temperature of the air supply is raised to about 150° F; if exhaust gas recirculation is employed, it is usually blended with the incoming air to raise the inducted air to approximately a 270° temperature, the temperature of the recirculated exhaust gas being about 640° F. Typical mass flows and temperature conditions for the external heating circuit at various stations identified in FIG. 1, would be as follows:

| | 4000 r.p.m. (Prior Art) | | |
|---|---|---|---|
| Location | m $\frac{LB}{HR}$ | t° F | p-psi |
| 1 | 2300 | 270 | 17 |
| 2 | 2300 | 270 | 17 |
| 3 | 2300 | 1620 | 16 |
| 4 | 2400 | 3500 | 15 |
| 5 | 2400 | 1880 | 15 |
| 6 | 2400 | 1880 | 15 |
| 7 | 2400 | 640 | 14 |

Sheet metal shrouding or conduit elements may be employed to construct the induction means. One portion 10 of the shrouding is arranged as an annular shell serving to annularly distribute the air supply to the underside or face 11 of the heat exchange matrix 12 in cooperation with insulated wall 13 for the closed working fluid circuit. Inducted air passes upwardly (axially with respect to axis 14 through first passages 15 of the foraminous matrix 12 to absorb heat units; the preheated air then exits from upper annular face 16. A conical shroud 17 turns the exiting flow and directs the preheated air radially inwardly to enter the combustion unit C. Combusted gases are driven out of the open end of the perforated shell 44 enclosing the combustion unit. The exhaust gases are turned and enter the matrix 12 through inner cylindrical face 21 after passing through the heater head tubes and transferring thermal energy to the working fluid. The exhaust gases continue through second passages 22 within the matrix and exit from cylindrical outer face 23.

The matrix 12 is comprised totally of ceramic formed as a toroid with the inner cylindrical 21 defining the outer limits of heating chamber D. The ceramic material is selected for strength and stability at temperature conditions of 2000° F; sufficient strength for heat exchange purposes must be about 200 psi. A ceramic material meeting these needs typically may comprise Magnesium Alumina Silicate or Lithium Alumina Silicate.

The toroidal shaped matrix 12 is formed of discrete layers of first passages 15 (see FIG. 2) interleaved with discrete layers of second passages 22, the first passages being arranged to direct flow at right angles to the flow passing through said second passages. In other words, flow in said first passages (for induction) is permitted axially while the flow in said second passages (for exhaust) is permitted in a transverse axial direction. The matrix achieves a honeycomb or cellular construction upon completion.

A typical method for constructing such concentric ceramic matrix is as follows:

1. Select a suitable ceramic material, typically Lithium Alumina Silicate; it is formed as a slurry mixed with resins to render a material having a consistency similar to a gum or other soft solid plastic material.

2. The soft solid material is formed into thin sheets and cut to specific cross-sectional dimensions equivalent to the cross-section of the matrix taken on a radial plane 24 thereof.

3. Each of the thin sheets are then passed through a continuous extruding device so as to form a plurality of precisely uniformly spaced and precisely determined fins 25 extending from the plane of the thin sheet serving as a wall 26. This step is equivalent to passing a corrugating roll over the thin sheet to form the plurality of fins 25.

4. The extruded sheets are interleaved, alternating orientation of the fins of successive sheets with respect to axis 21 but having all fins extending to the same side. This will provide said alternating flow passages both in an axial and transverse axial direction. The thin sheets are then held in a fixture while subject to a sintering temperature sufficient to vaporize the resin in said soft ceramic solid and ceramically bond the ends 25*a* of the fins 25 to the next adjacent sheet wall 27.

A typical matrix for a 170 h.p. Stirling engine may be approximately 18 inches in outer diameter 28, 13 inches in inner diameter 29, 25 inches in radial width 30 and 6 inches in height 31. The fin height 32, fin pitch 33 and wall thickness 34 are of particular importance in control of porosity through the ceramic matrix. The matrix ring may be subdivided into discrete arcuate modules 60 and 61, the modules being joined together at their ends 62. The joint is provided by sintered fusion of a compound at the joint plane; the joint serves to alleviate thermal stresses in the matrix at high operating temperatures. Such fusion material may be of the same material as the matrix. In some cases the joint may be contiguous without bonding.

It has been found that to obtain a worthwhile pressure drop through the preheater matrix, the fin pitch to fin height should be maintained in a ratio varying between 1:1 and 2:1, the fin pitch to fin weight ratio being employed must vary radially. The fin ratio for the second passages (being constant) is selected in this range dependent upon the total size allocated for the preheater by the design of the engine and general engine compartment space requirements. To obtain a pressure drop at full power conditions for a Stirling cycle engine, 47 centimeters of water is required at a design parameter. This necessitates approximately 450 openings per square inch for both flow passages 15 and 22, and requires a fin height of approximately 0.024 inches for the second passages and an average fin height of 0.024 inches for the first passages, a fin wall and sheet wall thickness of 0.005–0.010 inch and a fin pitch for the second passages of approximately 1:1 which converts to a fin spacing 39 of about 0.029 inch. If reduced pressure drop is to be required then a 2:1 ratio for the fin pitch to fin height of the second passages can be utilized.

To insure separation of cross-flow in the matrix, static seal rings (35, 36, 37, 38) are placed at and along the four annular adges of the torus, seals 35 and 36 being on face 16 and seals 37 and 38 being on face 11. Such seals are of a low cost design formed principally of ceramic material, such as Alumina and Silica Oxide. A preferable static seal construction may comprise a ceramic string fabricated by weaving, the string is fitted within a folded thin strip of stainless steel foil providing top and bottom protection. The foil encased ceramic string is then layed along the edges forming loops or rings at locations in FIG. 1 and held in place by slight compression imposed by the sheet metal shrouding (not shown) forming the fluid tight connection needed to separate intake and exhaust flow. The static or mechanical contact made with the preheater matrix is only along lines or narrow zones; all other faces of the matrix are exposed to flow.

The exhaust means B is comprised of an annular cylindrical shell 40 which collects gases exiting in a transverse or radially outward direction from the matrix. The upper and lower peripheries 41 and 42 of the shell 40 connect with seals 36 and 37 respectively and upper periphery 41 also connects with shroud 17 to divide flow. Sheet metal wall 43 extends from the inner periphery of the matrix (connecting with seal 35) and connects with the lower periphery of perforated shell 44 of the combustion unit to assist in direction of gases to the combustion unit. Insulation 45 is hung from wall 43 to define chamber D.

The burner unit C is comprised of a sparking element 46 and a fuel injection assembly 47 in extending through the upper central zone of the shell 44. The shell 44 is open at its bottom 19 for free flow of combustion gases into the heating chamber D. The heating chamber is defined by the semi-spherical heat resistant wall 43 (formed as a foor for chamber D about the bottom opening of the shell). Side walls of the heating chamber D are inherently formed by the inner face of the matrix 15.

Disposed within the heating chamber D is a series of heater tube arrays F which connect with a series of heat chambers 50, regenerators (not shown) and cooling spaces (not shown) which together form a closed working fluid system and impart work to the driven member of the engine. The array is formed of a series of cylindrical heat resistant tubes 55 which have one principal upward leg 55*a* and hairpin turn 55*b* which direct the tube along a horizontal leg 55*c* (the directions being taken with respect to FIG. 1). Suitable metallic fins 56 are attached about the horizontal legs 55*c* to increase heat exchange therebetween.

We claim:

1. In a Stirling engine having an external heating circuit in a closed working fluid system, an assembly for transferring heat from said circuit to said closed working fluid system, comprising:

(a) an induction means for providing a positive supply of air to said circuit, (b) an exhaust means for said circuit, (c) a combustion unit for adding fuel to said inducted supply of air and for combusting said air mixture, (d) a heating chamber receiving the products of combustion from said combustion unit and within which is disposed a heater tube array for absorbing a predetermined heat content of said combustion products passing thereabout, and (e) heat exchange means having a fixed matrix concentrically arranged about the axis of said heater tube array, said fixed matrix having walls defining layers of first passages interleaved with walls of defining layers of second passages, said induction means being fluidly connected to one end of said first passages and the combustion unit being fluidly connected to the other end of said first passages, said exhaust means being fluidly connected to one end of said second passages and the heating chamber being fluidly connected to the other end of said second passages, said fluid connections between said intake and exhaust, and between the heating chamber and burner unit, are provided by ceramic ring seals disposed along the edges of said concentrically arranged ceramic matrix, said fixed matrix being formed substantially of heat resisting ceramic material and being defined as a toroid comprised of fused segments, each of the edges of said toroid at opposite faces thereof having said ceramic seals in intimate contact therealong, the inner cylindrical wall of said concentric matrix serving to delimit the outer extremity of said heating chamber, said heating chamber needing no external side insulation other than the ceramic matrix.

2. In a Stirling engine having an external heating circuit in a closed working fluid system, as assembly for transferring heat from said circuit to said closed working fluid system, comprising:

(a) an induction means for providing a positive supply of air to said circuit, (b) an exhaust means for said circuit, (c) a combustion unit for adding fuel to said inducted supply of air and for combusting said air mixture, (d) a heating chamber receiving the products of combustion from said combustion unit and within which is disposed a heater tube array for absorbing a predetermined heat content of said combustion products passing thereabout, and (e) heat exchange means having a fixed matrix concentrically arranged about the axis of said heater tube array, said fixed matrix having walls defining layers of first passages interleaved with walls of defining layers of second passages, said induction means being fluidly connected to one end of said first passages and the combustion unit being fluidly connected to the other end of said first passages, said exhaust means being fluidly connected to one end of said second passages and the heating chamber being fluidly connected to the other end of said second passages, said fixed matrix being formed substantially of a heat resisting ceramic material, in which the inner cylindrical wall of said concentric matrix serves to delimit the outer extremity of said heating chamber, said heating chamber needing no external side insulation other than the ceramic matrix, said layer of second passages of said heat exchange means being defined by single ply flat ceramic walls each having fins projecting to one side thereof, said flat walls being interleaved one wall with the extremities of the fins against the other wall to form closed passages, the height of said fins varying in proportion to the distance along a radius of said matrix, and the walls and said flat wall thickness as well as said fins being of the order of 0.005–0.010 inches.

* * * * *